US005318347A

United States Patent [19]

Tseng

[11] Patent Number: 5,318,347

[45] Date of Patent: Jun. 7, 1994

[54] HEIGHT-ADJUSTABLE ARMREST UNIT FOR CHAIR

[75] Inventor: Chuen-Jong Tseng, Chiayi Hsien, Taiwan

[73] Assignee: Shin Yeh Enterprise Co., Ltd., Taiwan

[21] Appl. No.: 65,552

[22] Filed: May 20, 1993

[30] Foreign Application Priority Data

Oct. 19, 1992 [CN] China ..... 92236654.3

[51] Int. Cl.[5] ..... A47C 7/54

[52] U.S. Cl. ..... 297/411.36; 297/411.2

[58] Field of Search ..... 297/411.2, 411.23, 411.24, 297/411.35, 411.36, 411.37, 115, 411.26; 248/118.3, 118

[56] References Cited

U.S. PATENT DOCUMENTS

| | | | |
|---|---|---|---|
| 2,172,178 | 9/1939 | Rosenberg | 248/118 |
| 2,902,085 | 9/1959 | Bahnson, Sr. | 297/115 |
| 4,159,148 | 6/1979 | Schulz | 297/411.37 |
| 5,009,467 | 4/1991 | McCoy | 297/411.36 |
| 5,143,422 | 9/1992 | Althofer et al. | 297/115 X |

*Primary Examiner*—Kenneth J. Dorner

*Assistant Examiner*—Milton Nelson, Jr.

*Attorney, Agent, or Firm*—Ladas & Parry

[57] ABSTRACT

A height-adjustable armrest unit for a chair includes a support, a vertical sleeve, and a leverage body. The support is mounted securely on the seat of the chair and includes a vertical plate portion with a column of positioning holes formed therethrough. The vertical sleeve is disposed on the vertical plate portion of the support and has a pair of pivot holes respectively formed in the inner surfaces of two opposite side walls thereof. The leverage body includes an actuated upper end portion, an engaging tongue projecting from the lower end portion of the leverage body to engage selectively one of the positioning holes, and a pair of pivot pins respectively secured to an intermediate portion of the leverage body between the actuated upper end portion and the engaging tongue so as to engage the pivot holes respectively. Accordingly, when the actuated upper end portion is actuated to disengage the engaging tongue from the positioning hole, the assembly of the leverage body and the vertical sleeve can be moved relative to the support so as to engage the engaging tongue within another one of the positioning holes, thereby adjusting the height of the sleeve.

3 Claims, 5 Drawing Sheets

HEIGHT-ADJUSTABLE ARMREST UNIT FOR CHAIR

BACKGROUND OF THE INVENTION

1. Field of the Invention

This invention relates to an armrest unit for a chair, more particularly to an armrest unit which can be adjusted to a suitable height to satisfy the needs of the user.

2. Description of the Related Art

Referring to FIG. 1, a conventional chair includes a seat (A1), a pair of armrests (A2) connected securely to two opposite sides of the seat (A1), a movable base member (A3) mounted on the underside of the seat (A1), and a back member (A4) mounted on the rear portion of the seat (A1). A first adjustable member (A5) interconnects the back member (A4) and the seat member (A1) so as to adjust the back member (A4) to a suitable position. A second adjustable member (A6) interconnects the upper end of the base member (A3) and the underside of the seat (A1) so as to adjust the height of the seat (A1) to suit the user. Even though both of the base member (A3) and the back member (A4) are capable of being adjusted to a position that suits the user, the armrests (A2) cannot be adjusted to satisfy the user.

SUMMARY OF THE INVENTION

The main object of this invention is to provide a height-adjustable armrest unit for a chair which can adjust the armrests to a suitable height so as to satisfy the needs of the user.

According to this invention, a height-adjustable armrest unit for a chair includes a support, a vertical sleeve, and a leverage body. The support is mounted securely on the seat of the chair and includes a vertical plate portion with a column of positioning holes formed therethrough. The vertical sleeve is disposed on the vertical plate portion of the support and has a pair of pivot holes respectively formed in the inner surfaces of two opposite side walls thereof. The leverage body includes an actuated upper end portion, an engaging tongue projecting from the lower end portion of the leverage body to engage selectively one of the positioning holes of the support, and a pair of pivot pins respectively secured to the intermediate portion of the leverage body between the actuated upper end portion and the engaging tongue so as to engage the pivot holes of the vertical sleeve respectively. Accordingly, when the actuated upper end portion of the leverage body is actuated to disengage the engaging tongue of the leverage body from the positioning hole of the support, the assembly of the leverage body and the vertical sleeve can be moved relative to the support so as to engage the engaging tongue of the leverage body within another one of the positioning holes of the support, thereby adjusting the height of the sleeve.

BRIEF DESCRIPTION OF THE DRAWING

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 4:
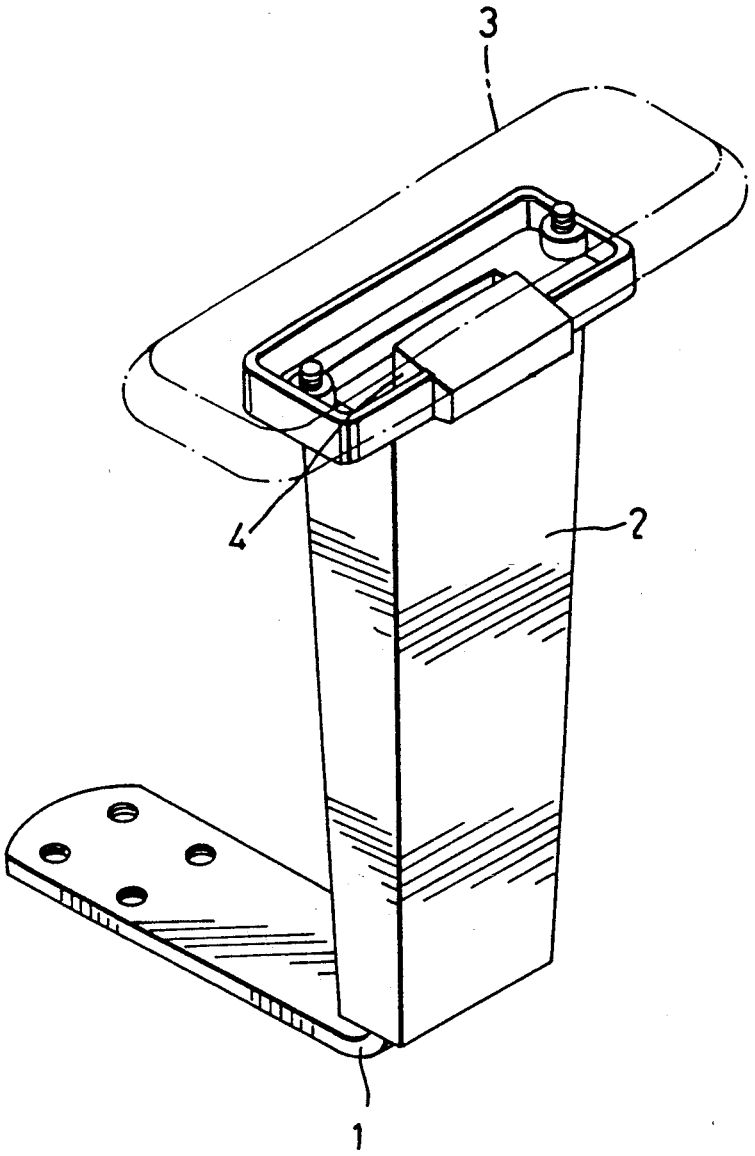
FIG. 4 is a perspective view of the height-adjustable armrest unit of this invention.

Referring to FIG. 4, a height-adjustable armrest unit of this invention is used for a chair (not shown) and includes a support (1), a vertical sleeve (2), an elongated horizontal armrest plate (3) (indicated by phantom lines), and a leverage body (4).

Figure 1:
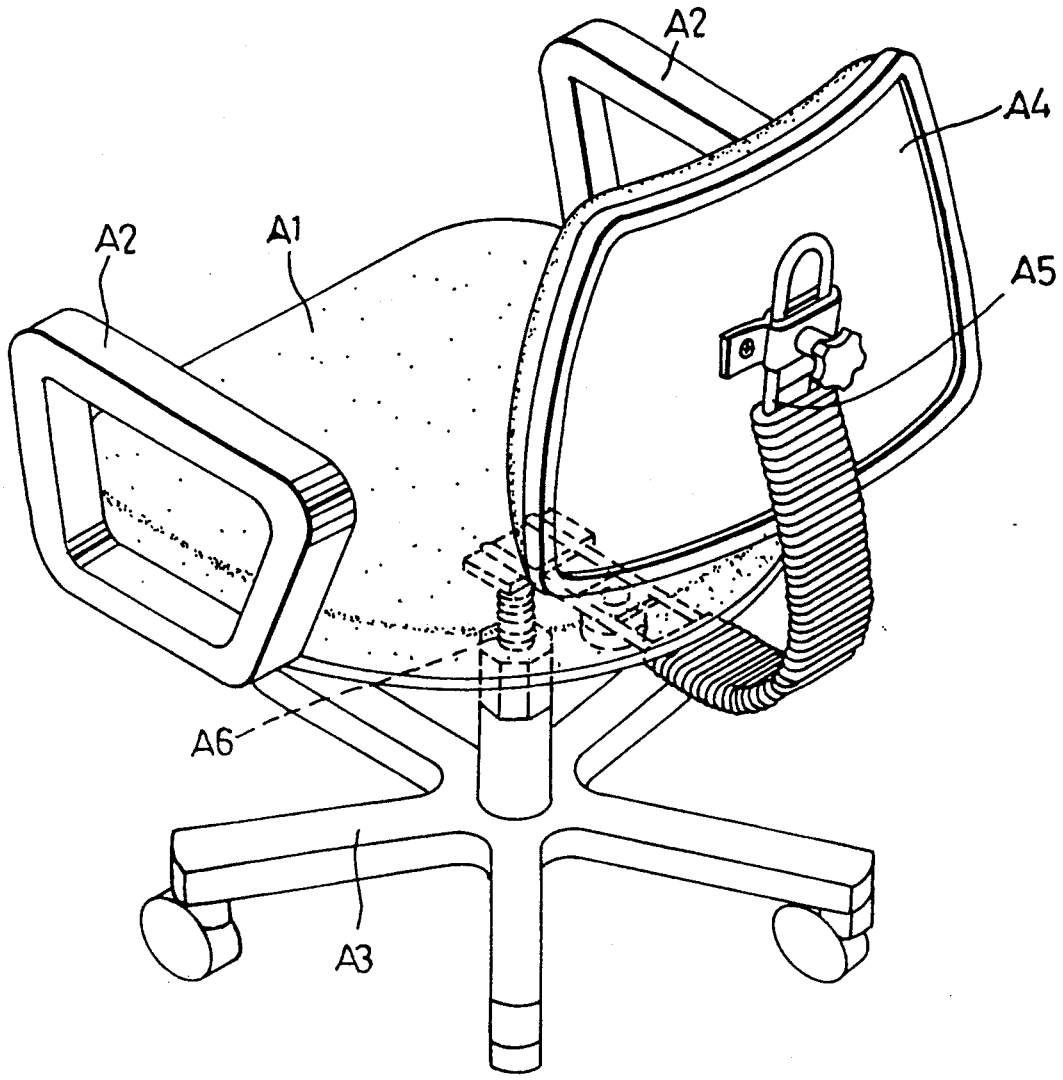
FIG. 1 PRIOR ART
FIG. 1 is a perspective view of a conventional chair.
Figure 2:
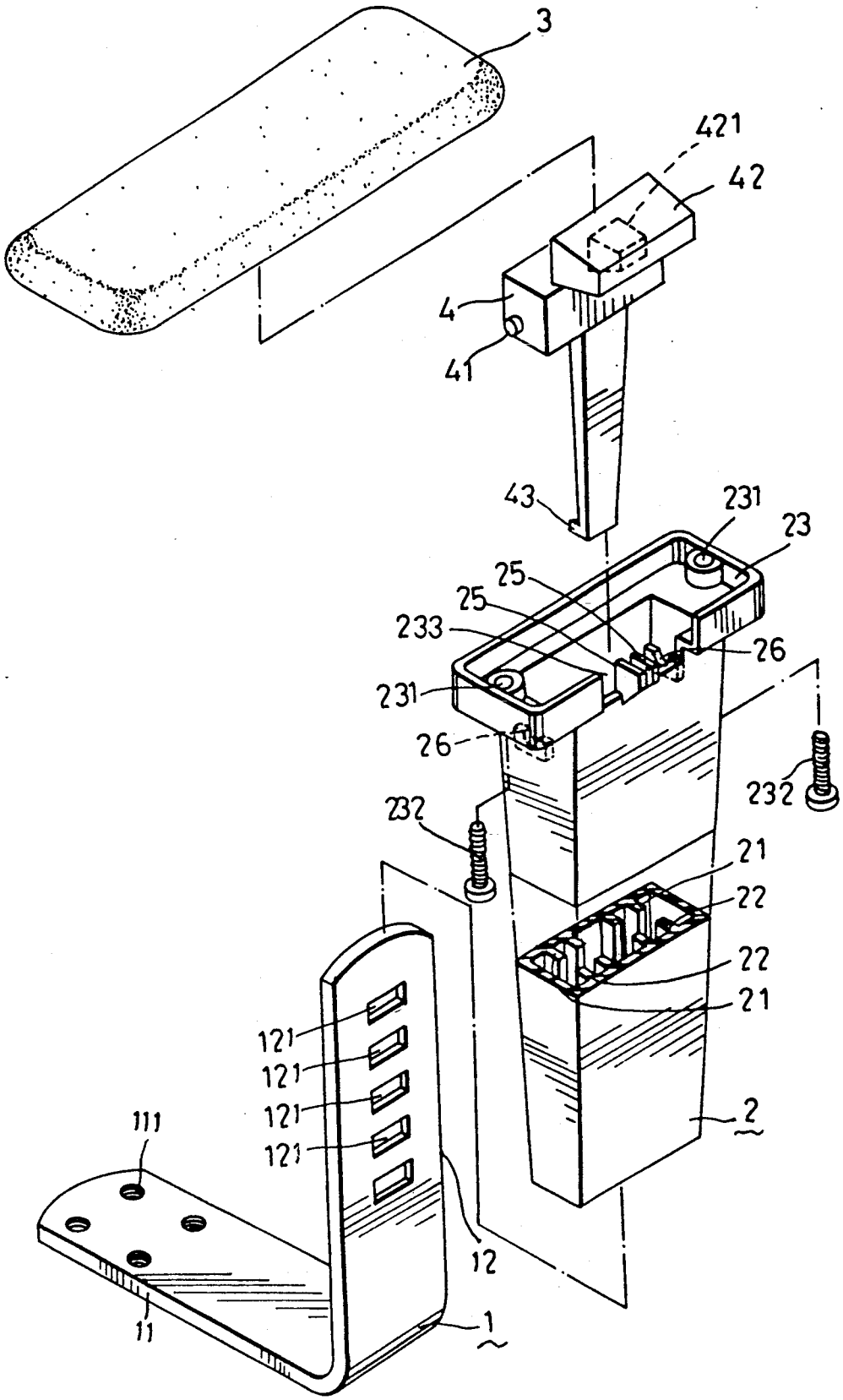
FIG. 2 is an exploded view of a height-adjustable armrest unit of this invention.
Figure 3:
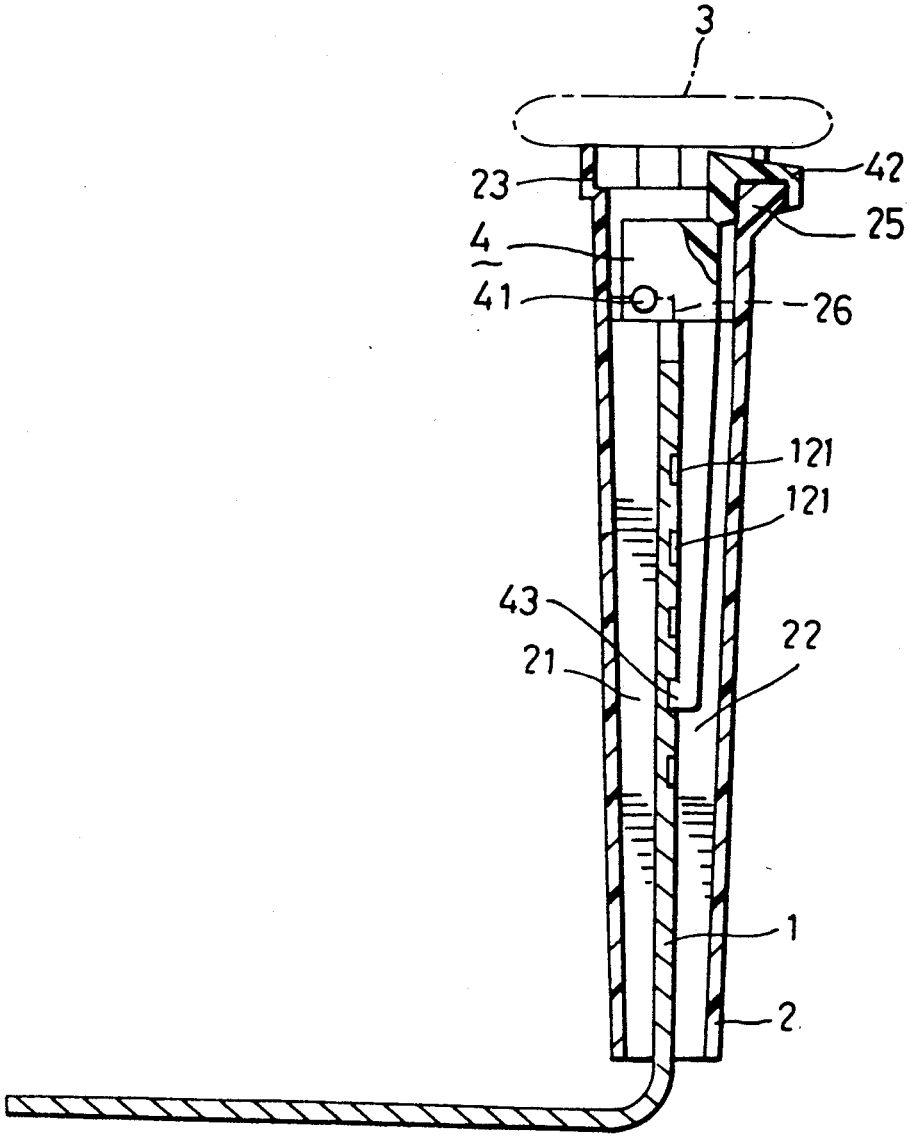
FIG. 3 is a sectional view of the height-adjustable armrest unit according to this invention.

Referring to FIGS. 2 and 3, the support (1) includes a horizontal plate portion (11) and a vertical plate portion (12) that has a lower end connected securely to one end of the horizontal plate portion (11). The horizontal plate portion (11) has four holes (111) formed in the other end thereof so as to secure the horizontal plate portion (11) of the support (1) to the underside of the seat of the chair by means of four bolts (not shown). The vertical plate portion (12) has a column of positioning holes (121) formed therethrough.

The vertical sleeve (2) is sleeved on the vertical plate portion (12) of the support (1) and includes four pairs of elongated integral reinforcing ribs (21, 22), a flange unit (23), two integral resilient plates (25), and a pair of pivot holes (26). The reinforcing ribs (21, 22) of each pair are aligned with each other and project respectively and inwardly from two opposite side walls of the vertical sleeve (2) so that the vertical plate portion (12) of the support (1) is positioned between any pair of the reinforcing ribs (21, 22) of the vertical sleeve (2). The flange unit (23) is located on the upper end portion of the vertical sleeve (2) and has a gap (233) formed therein and a pair of connecting holes (231) respectively formed in the inner surfaces of two opposite side walls thereof so that the armrest plate (3) is mounted removably on an upper end portion of the vertical sleeve (2) (see FIG. 4) by means of two bolts (232). The resilient plate (25) is integrally formed with the upper end portion of the vertical sleeve (2) and is located in the gap (233) of the flange unit (23). The pivot holes (26) are respectively formed in the inner surfaces of two opposite side walls of the vertical sleeve (2).

The leverage body (4) includes an actuated upper end portion (42), an engaging tongue (43), and a pair of pivot pins (41). The engaging tongue (43) projects from the lower end portion of the leverage body (4) in a direction to engage selectively one of the positioning holes (121) of the support (1), while the actuated upper end portion (42) projects from the leverage body (4) in the opposite direction. The actuated upper end portion (42) has a recess (421) that is formed in the bottom end portion thereof and that engages the resilient plate (25) of the vertical sleeve (2). The pivot pins (41) are respectively secured to the intermediate portion of the leverage body (4) between the actuated upper end portion (42) and the engaging tongue (43) so as to engage the pivot holes (26) of the vertical sleeve (2).

Figure 5:
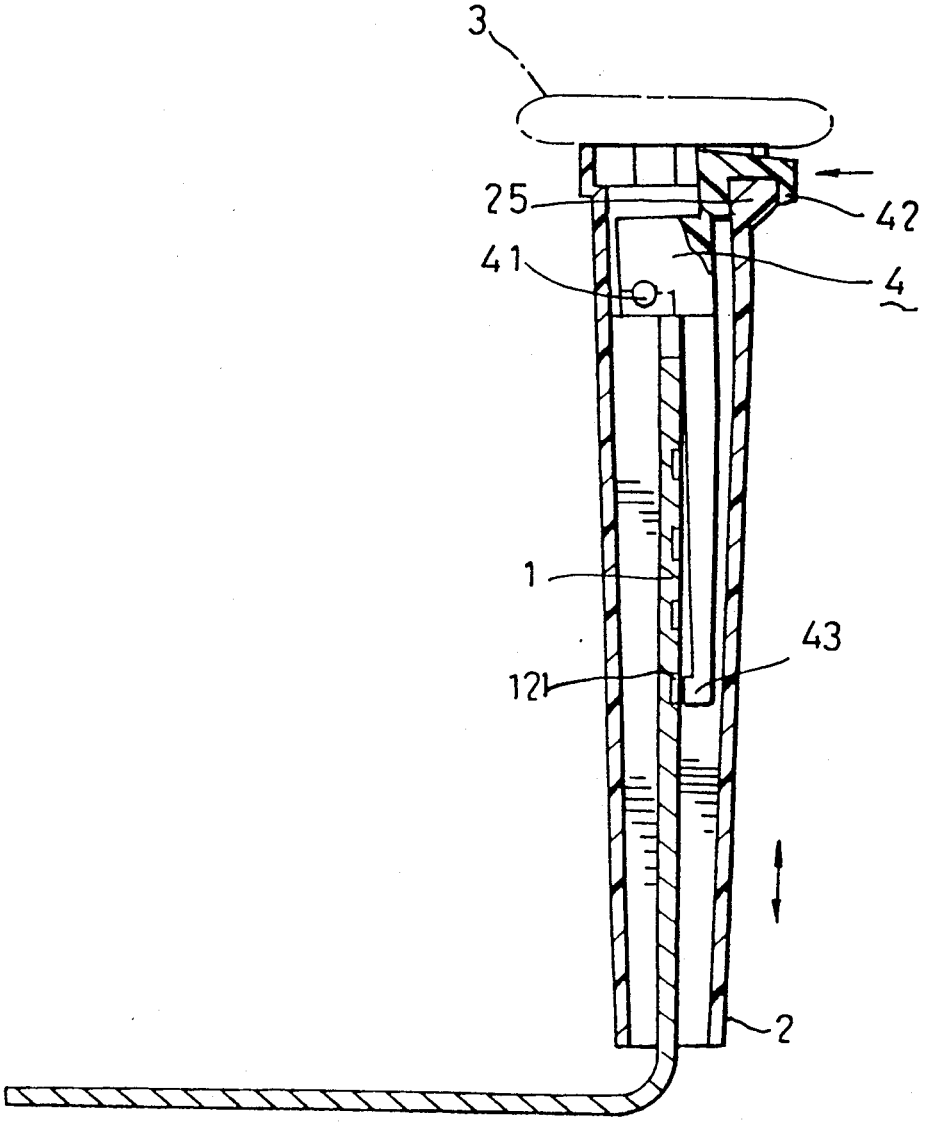
FIG. 5 is a schematic view illustrating how the height of the armrest unit is adjusted in accordance with this invention.

Referring to FIG. 5, when the actuated upper end portion (42) of the leverage body (4) is actuated to disengage the engaging tongue (43) of the leverage body (4) from the positioning hole (121) of the support (1), the assembly of the leverage body (4) and the vertical sleeve (2) can be moved relative to the support (1) so as to engage the engaging tongue (43) of the leverage body (4) within another one of the positioning holes (121) of the support (1), thereby adjusting the height of the sleeve (2). When the sleeve (2) is moved to align the engaging tongue (43) with a selected one of the positioning holes (121), the resilient plate (25) of the vertical sleeve (2) can bias the engaging tongue (43) of the leverage body (4) to engage within the selected one of the positioning holes (121). Accordingly, it is quite convenient for the user to adjust the armrest unit.

With this invention thus explained, it is apparent that numerous modifications and variations can be made without departing from the scope and spirit of this invention. It is therefore intended that this invention be limited only as indicated in the appended claims.

I claim:

1. A height-adjustable armrest unit for a chair, comprising:

a support adapted to be mounted securely on a seat of said chair and including a vertical plate portion with a column of positioning holes formed therethrough;

a vertical sleeve disposed on said vertical plate portion of said support and having a pair of pivot holes respectively formed in inner surfaces of two opposite side walls thereof; and a leverage body including an actuated upper end portion, an engaging tongue projecting from a lower end portion of said leverage body to engage selectively one of said positioning holes of said support, and a pair of pivot pins respectively secured to an intermediate portion of said leverage body between said actuated upper end portion and said engaging tongue so as to engage said pivot holes of said vertical sleeve respectively;

whereby, when said actuated upper end portion of said leverage body is actuated to disengage said engaging tongue of said leverage body from said positioning hole of said support, said leverage body and said vertical sleeve can be moved relative to said support so as to engage said engaging tongue of said leverage body within another one of said positioning holes of said support, thereby adjusting a height of said sleeve.

2. A height-adjustable armrest as claimed in claim 1, wherein said engaging tongue projects from said leverage body in a direction, while said actuated upper end portion projects from said leverage body in the opposite direction, said actuated upper end portion having a bottom end portion in which a recess is formed, said vertical sleeve including a resilient plate that is mounted securely on an upper end portion thereof and that is engaged within said recess so that, when said actuated upper end portion of said leverage body is actuated to disengage said engaging tongue of said leverage body from said positioning hole of said support and when said sleeve is moved to align said tongue with a selected one of said positioning holes of said support, said resilient plate of said vertical sleeve biases said engaging tongue of said leverage body to engage within said selected one of said positioning holes of said support.

3. A height-adjustable armrest unit as claimed in claim 1, wherein said height-adjustable armrest unit includes an elongated horizontal armrest plate mounted removably on an upper end portion of said vertical sleeve above said actuated upper end portion of said leverage body.

* * * * *